United States Patent [19]

Paikert

[11] Patent Number: 4,715,432

[45] Date of Patent: Dec. 29, 1987

[54] AIR-COOLED TUBE CONDENSER

[75] Inventor: Paul Paikert, Witten, Fed. Rep. of Germany

[73] Assignee: GEA Luftkuehlergesellschaft Happel GmbH & Co., Bochum, Fed. Rep. of Germany

[21] Appl. No.: 893,564

[22] Filed: Aug. 5, 1986

Related U.S. Application Data

[63] Continuation-in-part of Ser. No. 738,024, May 24, 1985, abandoned.

[30] Foreign Application Priority Data

May 26, 1984 [DE] Fed. Rep. of Germany ..... 3419734

[51] Int. Cl.[4] ..... F28B 1/00

[52] U.S. Cl. ..... 165/110; 165/900; 165/179; 138/40

[58] Field of Search ..... 165/DIG. 1, 110, 151, 165/177, 179, 152; 138/37, 38, 40

[56] References Cited

U.S. PATENT DOCUMENTS

| | | | |
|---|---|---|---|
| 1,396,633 | 11/1921 | Jensen | 165/177 |
| 2,078,766 | 4/1937 | Mack | 165/177 X |
| 2,151,540 | 3/1939 | Varga | 165/179 |
| 2,614,816 | 10/1952 | Hull | 165/110 |
| 2,655,181 | 10/1953 | Cooper | 165/152 X |
| 3,603,384 | 9/1971 | Huggins | 165/151 X |
| 3,783,938 | 1/1974 | Chartet | 165/179 X |
| 3,976,126 | 8/1976 | Ruff | 165/900 X |

*Primary Examiner*—Albert W. Davis, Jr.
*Assistant Examiner*—Peggy Neils
*Attorney, Agent, or Firm*—Michael J. Striker

[57] ABSTRACT

In an air-cooled surface condensor including a plurality of elongated finned heat exchanger tubes arranged in a single row, each tube has a continually increasing cross-sectional area from a front end to a rear end of the tube in the direction of flowing of cooling air. A separating wall provided with perforations is mounted within each tube.

4 Claims, 5 Drawing Figures

AIR-COOLED TUBE CONDENSER

CROSS-REFERENCE TO A RELATED APPLICATION

This application is a continuation-in-part of application Ser. No. 738,024 filed May 24, 1985 and now abandoned.

BACKGROUND OF THE INVENTION

The present invention relates to an air-cooled tube condenser which includes a plurality of elongated heat exchanger tubes arranged in a row and each being covered with transverse fins.

Heat exchanger tubes employed in the tube condensers of the type under discussion have, as compared to presently utilized elliptical, finned tubes, a doubled or three-time larger ratio between the greatest length of the tube and its greatest width; to condense the same amounts of steam, such tubes being arranged in three or more rows positioned in the direction of cooling air flow one after another. The advantage of such tubes resides in that a pressure compensation can be obtained at each place of the tube between all the regions of the tube cross-section. Thereby the condensation of vapor in the front tube portions, facing the flow of cooling air ends exactly at the same time at which its ends in the rear end portion of the tube, as viewed in the direction of cooling air flow. The danger of the occurrence of dead zones is thus evidently prevented or totally eliminated. The required length-width ratios lead to greater inside width of the tubes. Flow pressure losses in the heat exchanger tubes arranged one after another in the direction of cooling air flow and having the same cross-section for condensing the same amounts of vapor have been reduced to fractions as compared to losses in tubes of greater hydraulic diameters.

Despite the fact that heat-exchanger tubes are rather long they have good cross-section stability and can be manufactured with required precision without the danger of being distorted or deformed. Stability of the tube cross-section is so high that further hot dip galvanization or the like heat treatment would present no problem. Heat exchanger tubes which are very long, for example of 10 m, can be finned by means of conventional finning machines.

Although heat exchanger tubes having length-width ratio of about 8:1 and more have proven to be reliable practice has shown that heat transfer coefficients of such tubes can be improved.

SUMMARY OF THE INVENTION

It is an object of the present invention to provide an improved air-cooled tube condenser.

It is another object of this invention to provide an air-cooled tube condenser in which elongated finned tubes would have better transfer qualities.

These and other objects of the invention are attained by an air-cooled surface condenser including a plurality of condenser elements having heat exchanger tubes provided with transverse fins and being elongated in the direction of cooling air flow and being arranged in a single row extending transversely of the direction of air flow and each having a length many times greater than the width of the tube and being rounded at ends thereof, each finned heat exchanger tube having a changing cross-sectional area from one end to another end in said direction and including two continually changing portions which are symmetrical relative to a central plane of elongation of the tube, each tube having a front end portion and a rear end portion, as viewed in said direction, each tube having a cross-section which continually increases in the direction of elongation of the tube from said front end portion to said rear end portion and having opposite side walls each of which is slightly curved outwardly over the length of the tube from said front end portion to said rear end portion, each tube having an integral separating wall extended in a middle transverse plane of the tube and projecting over the entire depth of the tube, said separating wall being formed with a plurality of spaced perforations provided in the region of one of said opposite side walls.

The increase of the tube cross section in the direction of the air flow results in decrease of the air-side remaining cross section between the tubes and leads to an acceleration of the cooling air stream.

Intensive research has shown that heat transfer coefficients in the region of accelerated air flows is effectively higher than in the region of decelerated flows. The cause of such substantially higher heat transfer coefficients in the region of accelerated flows is a decrease of the boundary layers at least a smaller increase of the boundary layers as compared to the regions having non-accelerated or even decelerated air streams.

Each tube may have at least two side portions spaced from each other in said direction and each being concave in respect to said central plane of elongation and of a cross-sectional area reduced relative to that of said front end portion, and an intermediate portion connecting said side portions to each other and being convexly curved relative to said central plane of elongation. In such case multi-curved side walls substantially increase rigidity of the heat exchanger tube. Furthermore, due to the alternation of an accelerated and retarded air flow, such a structure of the tubes results in an earlier separation of limiting air layers flowing along the heat exchanger tube. Finally, additional fins can be provided in the middle region of each tube.

For substantially increasing heat transfer coefficients of the heat exchanger tubes the ratio of an outer surface of each tube to the width of said front end portion is between 80:1 and 160:1. The cross-section of each tube has a length-width ratio between 8:1 to 16:1. Heat exchanger tubes of such dimension ratios can be from 8 to 12 m long without requiring additional supporting members.

It is particularly advantageous that each of the fins may have a front portion extended forwardly of said front end portion of the tube and a rear portion extended rearwardly of said rear end portion of the tube, the length of said rear portion being between two and three times greater than the length of said front portion. This structure has been proposed due to fact that rear tube portions, as viewed in the direction of cooling air flow, are heated-up so much that only a small difference exists between the temperature of cooling air and the temperature of the fin surfaces. Thus the fin surfaces at these tube portions are cooled down insignificantly. Therefore the surfaces of the fins that are remote from the heat exchanger tubes have relatively high temperatures despite low efficiency of the fins at this area. Thus they have considerably small temperature differences than the fin portions at the front ends of the tubes which are exposed to intensive cooling due to greater temperature differences.

The separating wall further contributes to stability of the elongated heat exchanger tube. Another function of the separating wall is that the condensate collected in the heat exchanger tube can be drained therefrom in two separate streams while excessive vapor in one of the tube halves can penetrate into the other tube half through the perforations.

The advantage of the heat exchanger tubes, provided with the perforated separating wall, resides in that dead zones normally occuring in parallel heat exchanger tubes, can not occur because the vapor penetration into both tube halves acts as one tube but concerning a separate collection of the condensate it acts as two individual tubes. Thus the advantage of a lesser blocking of the tube with the better cooling action is maintained because a portion of condensate remains in the middle region of the tube and thus outside the region in which greater heat flux penetrates the walls of the heat exchanger tube.

The manufacture of the heat exchanger tubes of this invention can be carried out by various methods. It is possible, for example to produce a separating wall of the tube in various fashions. It is conceivable, for example to insert such a wall into a preliminarily formed tube and attach the wall to the tube. It is however, advantageous that each tube can be bent together with said wall from a single sheet of metal. The manufacture of the conical tube from a flat sheet can take place by means of a respective device, and a separating wall, if required, can be made separately from the tube and then secured to the tube.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 5:
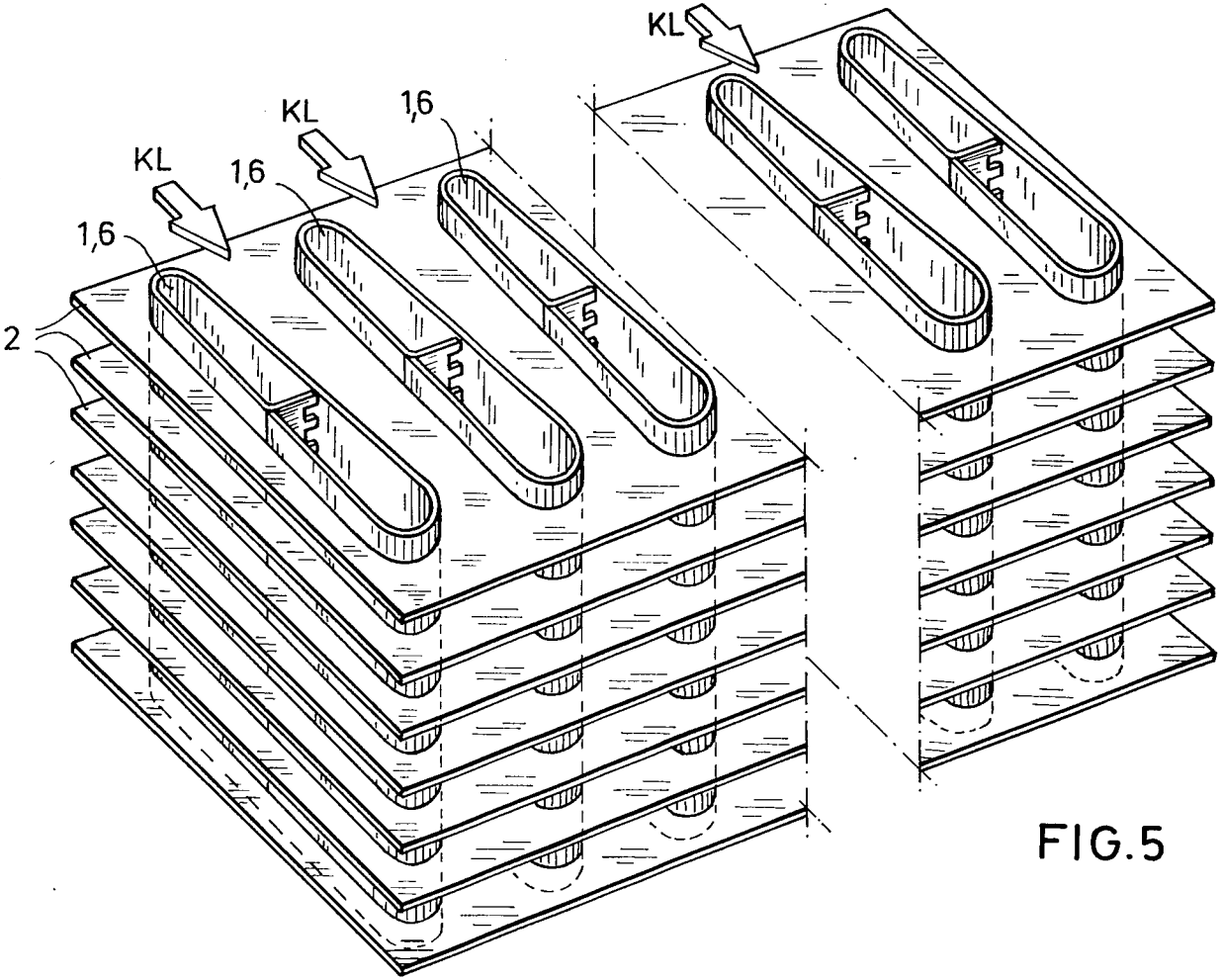
FIG. 5 is a perspective view of a portion of surface condenser according to the invention.

An air-cooled surface condenser including a plurality of condenser elements is partly shown in FIG. 5. A plurality of equally spaced fins 2 is orthogonally oriented with respect to and transversed by a row of heat exchanger tubes 6 shown in FIG. 2.

Figure 1:
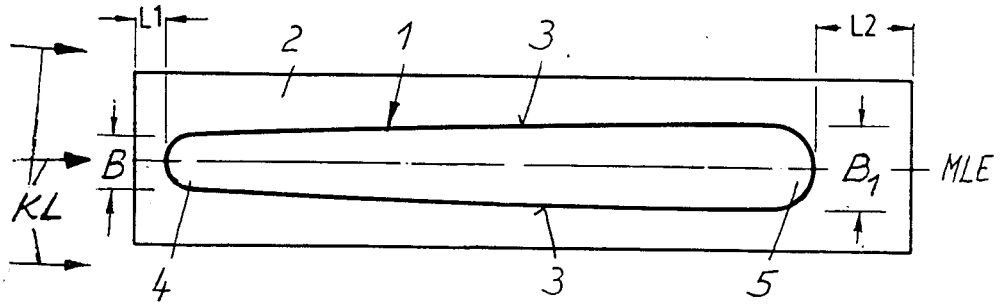
FIG. 1 is a schematic side view of the heat exchanger tube according to a first embodiment of the invention.

Referring now to the drawings in detail, and firstly to FIG. 1, a heat exchanger tube 1 is a structural component of a condenser element of an air-cooled condenser. The heat exchanger tube 1, which is elongated in the direction normal to the plane of the drawing, is provided with vertically extended fins 2 and is at one end thereof connected, for example, via end chambers, to steam-distribution and condensate, collecting or air-suction conduits in the known fashion. Only one row of finned heat exchanger tubes 1, positioned one after another and extended transversely to the direction of air flow KL, is provided in each condenser element.

The heat exchanger tube 1 has in the direction of flow of cooling air KL an elongated, changing cross-section and is rounded at two ends thereof. A side wall 3 of the heat exchanger tube 1 is slightly curved outwardly. Due to the conical cross-section of the tube 1 this tube has in the direction of the cooling air flow KL a continually changing cross-section at two sides thereof relative to an axial plane MLE. The width B at the front end portion 4 of the tube, as viewed in the direction of air flow, is smaller than the width $B_1$ at the rear end portion 5 of the tube.

The ratio between the length and the width of the tube 1, loaded with steam, is from 8:1. The ratio of the air-contacting outer surface to the cross-section area of the width B of the tube at the front end portion 4 is about from 80:1 to 160:1.

Fins 2 are non-symmetrically arranged or offset relative to the heat exchanger tube 1 in the direction of cooling air flow KL, as shown in FIGS. 1, 2, 4 and 5. The dimensions of the offset portions are such that the length of the fin portion L2 projecting beyond the rear end of tube is somewhat two or three times greater than the length of the fin portion L1 which projects forwardly of the front end of the tube 1.

Figure 2:
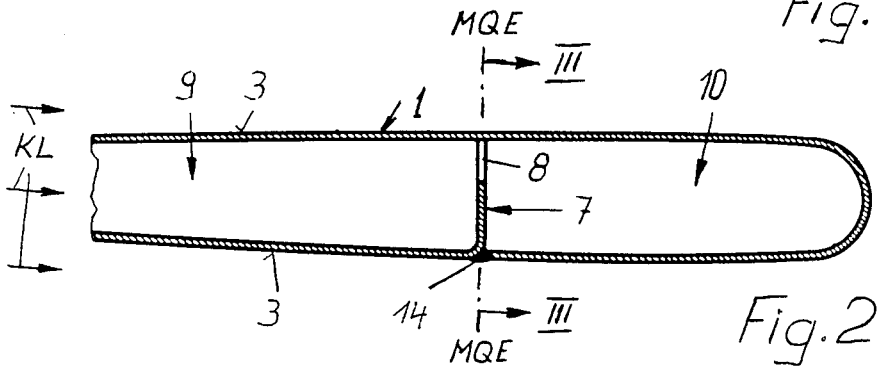
FIG. 2 is a partial sectional view of the individual heat exchanger tube of FIG. 1 in greater detail but without a fin.
Figure 3:
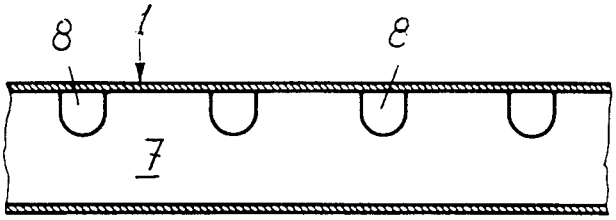
FIG. 3 is a section taken along line III—III of FIG. 2.

As shown in FIGS. 2 and 3 the heat exchanger tube 1 according to the invention has internal elements 7. These internal elements are each formed by a separating wall which is provided in the middle transversal plane MQE and extends over the depth of heat exchanger tube 1. The separating wall 7 has a plurality of perforations 8 spaced from each other in the transverse direction of the heat exchanger tube and provided over the entire length of the wall. Each perforation 8 has a substantially U-shaped cross-section. Perforations 8 are arranged in the wall 7 so that the condensate porduced in both halves of the tube 9, 10 can be drained off separately. Excessive steam can flow from the rear tube half 10, as view in the cooling flow direction, via perforations 8 into the front tube half 9.

Figure 4:
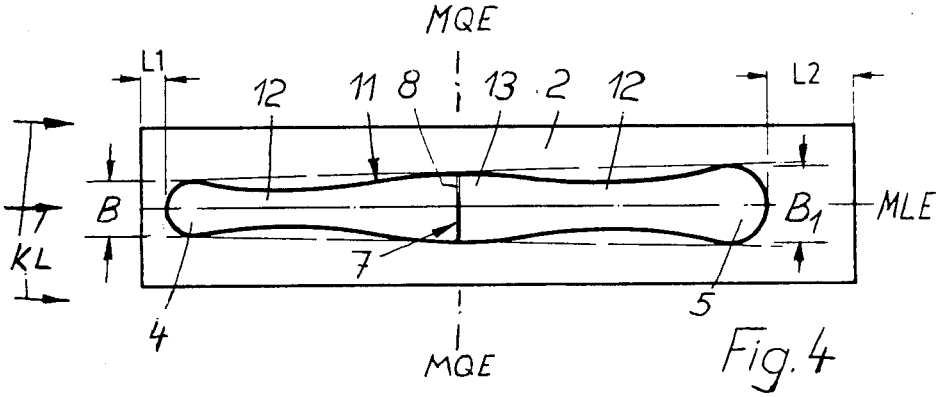
FIG. 4 is a schematic side view of another embodiment of the invention.

In the embodiment shown in FIG. 4 the heat exchanger tube 11 has also a changing cross-section, and width B at the front end portion 4 of the tube is smaller than the cross-sectional width $B_1$ at the rear end portion 5. The two halves of the tube are also separated from each other by inner wall 7. Each tube half has at least one portion 12 of reduced cross-section so that at least two portions 12, spaced from each other in the direction of cooling flow, are provided in the heat exchanger tube. Each reduced portion 12 has a concavely curved wall. An outwardly curved convex middle portion 13 extends between and merges into reduced portions 12. However, in this embodiment the cross-sectional area at the middle plane MOE is greater than the cross-sectional width B at the front end of the tube, whereas the cross-sectional width $B_1$ is greater than the cross-sectional area in the region of the middle plane MOE. Similarly to the embodiment of FIG. 4 the length L2 of the fin portion, projecting beyond the rear tube portion 5, is about from two times to three times greater than the length L2 of the fin portion, extending forwardly of the front tube portion 4. The inner separating wall 7 of the heat exchanger tube, which extends through the middle transversed plane MOE, is formed with a plurality of perforations 8 spaced from each other in the same fashion as in the embodiment of FIGS. 2, 3.

The manufacture of heat exchanger tubes 1, 6, 11 and also of a perforated separating wall 7 is carried out preferably by bending from a one-piece flat sheet. The inwardly bent wall 7 leaves a free edge on the blank of the tube. This free edge is closed by a weld seam 14.

It will be understood that each of the elements described above, or two or more together, may also find a useful application in other types of air-conditioned surface condenser differing from the types described above.

While the invention has been illustrated and described above, or two or more together, may also find a useful application in other types of air-conditioned surface condenser differing from the types described above.

While the invention has been illustrated and described as embodied in an air cooled surface condensers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An air-cooled surface condenser comprising a plurality of heat exchanger tubes provided with transverse fins and being elongated in the direction of cooling air flow and being all arranged in a single row extending transversely of the direction of air flow and each having a length many times greater than the width of the tube and being rounded at ends thereof, each finned heat exchanger tube having a changing cross-sectional area from one end to another end in said direction and including two continually changing portions which are symmetrical relative to a central plane of elongation of the tube, each tube having a front end portion and a rear end portion, as viewed in said direction, each tube having a cross-section which continually increases in the direction of elongation of the tube from said front end portion to said rear end portion and having opposite side walls each of which is slightly curved outwardly over the length of the tube from said front end portion to said rear end portion, each tube having an internal separating wall extended in a middle transverse plane of the tube and projecting over the entire depth of the tube, said separating wall being formed with a plurality of spaced perforations provided in the region of one of said opposite side walls over the entire length of said separating wall whereby each tube is rigid and permitting a condensate collected in the tube to be drained in two separate streams while an excessive vapor in one of halves of the tubes separated by said separating wall can penetrate into another half of the tube through said perforations.

2. The condenser as defined in claim 1, wherein the cross-section of each tube has a length-width ratio between 8:1 to 16:1.

3. The condenser as defined in claim 1, wherein each of said fins has a front portion extended forwardly of said front end portion of the tube and a rear portion extended rearwardly of said rear end portion of the tube, the length of said rear portion of the fin being between two and three times greater than the length of said front portion.

4. The condenser as defined in claim 1, wherein each tube together with said separating wall is bent from a single sheet of material.

* * * * *